United States Patent [19]

DiTullio et al.

[11] 4,162,463

[45] Jul. 24, 1979

[54] DIPLEXER APPARATUS

[75] Inventors: Joseph G. DiTullio, Woburn; Leonard I. Parad, Framingham, both of Mass.

[73] Assignee: GTE Sylvania Incorporated, Stamford, Conn.

[21] Appl. No.: 863,807

[22] Filed: Dec. 23, 1977

[51] Int. Cl.[2] ..... H01P 1/17; H01P 1/20; H01P 5/16

[52] U.S. Cl. ..... 333/117; 333/126; 333/135; 333/21 A

[58] Field of Search ..... 333/6, 9, 11, 21 A; 343/100 PE, 756, 786

[56] References Cited

U.S. PATENT DOCUMENTS

| | | | |
|---|---|---|---|
| 3,024,463 | 3/1962 | Moeller et al. | 343/786 X |
| 3,731,236 | 5/1973 | DiTullio et al. | 333/9 |
| 3,978,434 | 8/1976 | Mörz et al. | 333/6 |
| 4,047,128 | 9/1977 | Morz | 333/21 A X |
| 4,100,514 | 7/1978 | DiTullio et al. | 333/21 A |

*Primary Examiner*—Paul L. Gensler
*Attorney, Agent, or Firm*—Peter Xiarhos

[57] ABSTRACT

A microwave diplexer apparatus for handling simultaneously two independent polarized transmitted signals at one frequency and two independent polarized received signals at a lower frequency. In the transmit mode of operation of the diplexer apparatus, a pair of input signals to be transmitted to a target are applied to a first orthogonal mode transducer wherein the electric fields of the signals are established at right angles to each other. The orthogonal linearly-polarized signals are then transformed by a pin/ridge-loaded circular polarizer device to oppositely-rotating circularly-polarized signals and coupled via an antenna port of a second orthogonal mode transducer to an antenna for transmission to the desired target.

In the receive mode of operation, a pair of independent oppositely-rotating circularly-polarized signals from the target are received and coupled via the antenna port of the second orthogonal mode transducer to other ports of the second orthogonal mode transducer to which pairs of arms having pins and ridges associated therewith are coupled for introducing a phase shift differential to the vectoral components of the circularly-polarized signals as established within the pairs of arms. The vectoral components in each pair of arms are combined within a third orthogonal mode transducer so as to be orthogonal and linearly-polarized with respect to each other and then applied to a fourth orthogonal mode transducer wherein a pair of resultant, orthogonal, linearly-polarized signals corresponding to the two circularly-polarized signals are derived and applied to separate output ports.

14 Claims, 6 Drawing Figures

DIPLEXER APPARATUS

CROSS-REFERENCE TO RELATED APPLICATIONS

In co-pending patent application Ser. No. 791,969, now U.S. Pat. No. 4,100,514, filed Apr. 28, 1977 in the names of Joseph G. DiTullio and Leonard I. Parad, and entitled "Broadband Microwave Polarizer Device", there is disclosed and claimed a broadband microwave polarizer device which may be employed in the present invention.

In co-pending patent application, Ser. No. 863,808, filed concurrently with the present application in the names of Joseph G. DiTullio, Leonard I. Parad and Donald J. Sommers, and entitled "Diplexer Apparatus," there is disclosed and claimed a diplexer apparatus representing a variation of the diplexer apparatus is disclosed in the present application.

BACKGROUND OF THE INVENTION

The present invention relates to a microwave diplexer apparatus and, more particularly, to a microwave diplexer apparatus capable of handling simultaneously two transmitted signals and two received signals in conjunction with a single antenna.

Diplexer apparatus capable of handling simultaneously pairs of transmitted and received signals associated with a single antenna are well known to those skilled in the art. By way of example, diplexer apparatus capable of the above type of operation is disclosed in U.S. Pat. No. 3,731,235, issued May 1, 1973 in the names of Joseph G. DiTullio, Leonard I. Parad and Kenneth E. Story, and also in U.S. Pat. No. 3,731,236, issued May 1, 1973 in the names of Joseph G. DiTullio, Donald J. Sommers and Windsor D. Wright, both of the above patents being assigned to the same assignee as the present application. While the apparatus as described in the abovementioned patents is satisfactory in many communication systems, the apparatus has been used heretofore for the handling of linearly-polarized signals as opposed to circularly-polarized signals. It has further been recognized that it is desirable for any diplexer apparatus, whether employed to handle linearly-polarized or circularly-polarized signals, to have as short an overall length as possible to reduce losses in the apparatus. This reduction in the overall length of a diplexer apparatus has the further advantage of permitting the apparatus to be used in installations where space is at a premium, for example, in installations employing small antennas (e.g., 8–16 meter diameter) as opposed to the more conventional larger antennas (e.g., 32 meter diameter).

SUMMARY OF THE INVENTION

In accordance with the present invention, a diplexer apparatus is provided which may be employed to handle circularly-polarized signals and which is characterized by low losses and reduced overall length. The diplexer apparatus in accordance with the invention includes a first transducer means having first and second input ports and an output port. The first transducer means is operative to receive first and second signals within a first frequency bandwidth at the first and second input ports, respectively, and to establish said signals at the output port thereof to be orthogonal and linearly-polarized with respect to each other.

A first polarizer means is coupled to the first transducer means and operates to transform the orthogonal linearly-polarized signals at the output port of the first transducer means to orthogonal circularly-polarized signals. An electromagnetic wave conducting means having a first port and a second port is coupled via the first port to the first polarizer means and operates to pass circularly-polarized signals produced by the first polarizer means to the second port thereof. The electromagnetic wave conducting means further has a third port and a fourth port and further operates to receive first and second circularly-polarized signals within a second frequency bandwidth at the second port thereof and to couple orthogonal vectoral components of the circularly-polarized signals to the third and fourth ports thereof.

A second polarizer means is coupled to the third and fourth ports of the electromagnetic wave conducting means and operates to introduce a predetermined phase shift differential between the vectoral components of the circularly-polarized signals at the third and fourth ports. These phase shifted vectoral components are established so as to be orthogonal and linearly-polarized with respect to each other. An output means having first and second output ports is coupled to the second polarizer means and operates to combine the vectoral components of the orthogonal linearly-polarized signals derived by the second polarizer means from the first and second circularly-polarized signals into first and second resultant orthogonal linearly-polarized signals each corresponding to a different one of the circularly-polarized signals and to present the first and second resultant linearly-polarized signals to separate ones of the first and second output ports thereof.

BRIEF DESCRIPTION OF THE DRAWING

Various objects, features and advantages of a microwave diplexer apparatus in accordance with the present invention will be apparent from the following detailed discussion taken in conjunction with the accompanying drawing in which.

DETAILED DESCRIPTION OF THE INVENTION

Figure 1:
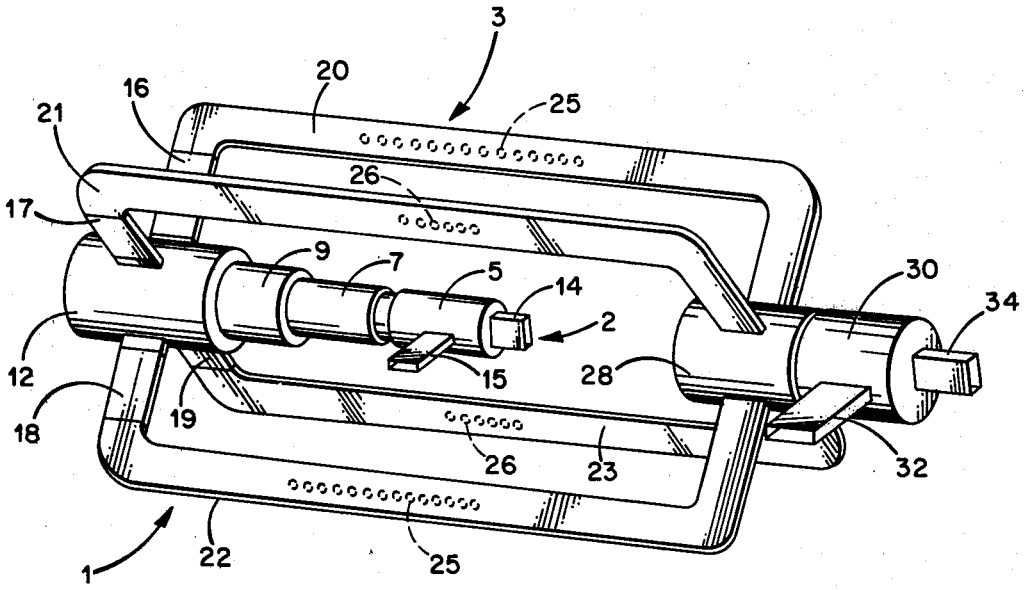
FIG. 1 is a perspective view of a microwave diplexer apparatus in accordance with the present invention.

Referring now to FIG. 1, there is shown in a perspective view a microwave diplexer apparatus 1 in accordance with the present invention. The diplexer apparatus 1 is shown in FIG. 1 generally includes a first portion 2 for processing a pair of independent input signals for transmission to a target, specifically, in a circularly-polarized form, and a second portion 3 for processing a pair of independent circularly-polarized signals as received from the target into individual signals for use by receiver apparatus employed in conjunction with the diplexer apparatus 1. In the usual operation of the diplexer apparatus 1, the transmitted signals are of a first frequency within a first frequency bandwidth, for example, a bandwidth of 5.925 Ghz–6.425 Ghz, and the received signals are of a second, lower frequency within a second frequency bandwidth, for example, a bandwidth of 3.7 Ghz–4.2 Ghz. The transmission and reception of signals is accomplished by the use of a single antenna and the processing of the transmitted and received signals as mentioned hereinabove may be accomplished in a simultaneous, mutually-exclusive fashion. As is well understood, the diplexer apparatus 1 operates on the principle of reciprocity and the transmit and receive functions may be reversed without necessitating changes in the diplexer apparatus itself.

The transmission of signals in a circularly-polarized form to a target is accomplished by the diplexer apparatus 1 by utilizing a series arrangement of components including a first orthogonal mode transducer 5, a circular polarizer device 7, an impedance-matching transformer device 9, and a second orthogonal mode transducer 12. An antenna (not shown) is arranged to be coupled to the second orthogonal mode transducer 12 by means of a suitable adapter (also not shown) so that signals from the diplexer apparatus 1 may be appropriately directed by the antenna toward a target during the transmit mode.

A pair of signals to be processed into a circularly-polarized form for transmission to a target by the antenna are applied to two separate sections of rectangular waveguide 14 and 15 of the orthogonal mode transducer 5. These signals are of the same (higher) frequency within the transmit frequency bandwidth (5.925 Ghz–6.425 Ghz) and are conducted into the circular waveguide section of the orthogonal mode transducer 5. As is well understood, due to the symmetry of the circular waveguide section of the orthogonal mode transducer 5 and the orthogonal orientation and propagation properties of the rectangular waveguide sections 14 and 15 of the orthogonal mode transducer 5, the electric fields of the signals applied to the rectangular waveguide sections 14 and 15 are established, or polarized, within the orthogonal mode transducer 5 to be at right angles to each other and also to the planes of the broad walls of the respective sections of waveguide 14 and 15. The orthogonal linearly-polarized signals so established within the orthogonal mode transducer 5 are coupled into the circular polarizer device 7. The linearly-polarized signals are converted, or transformed, within the circular polarizer device 7 to oppositely-rotating, circularly-polarized signals.

Figure 2:
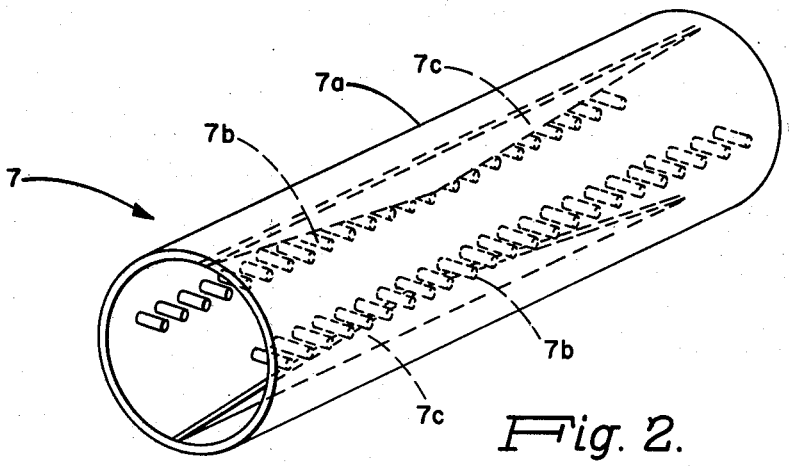
FIG. 2 is an enlarged perspective view of a circular waveguide broadband polarizer device which may be employed in the diplexer apparatus of FIG. 1.
Figure 3:
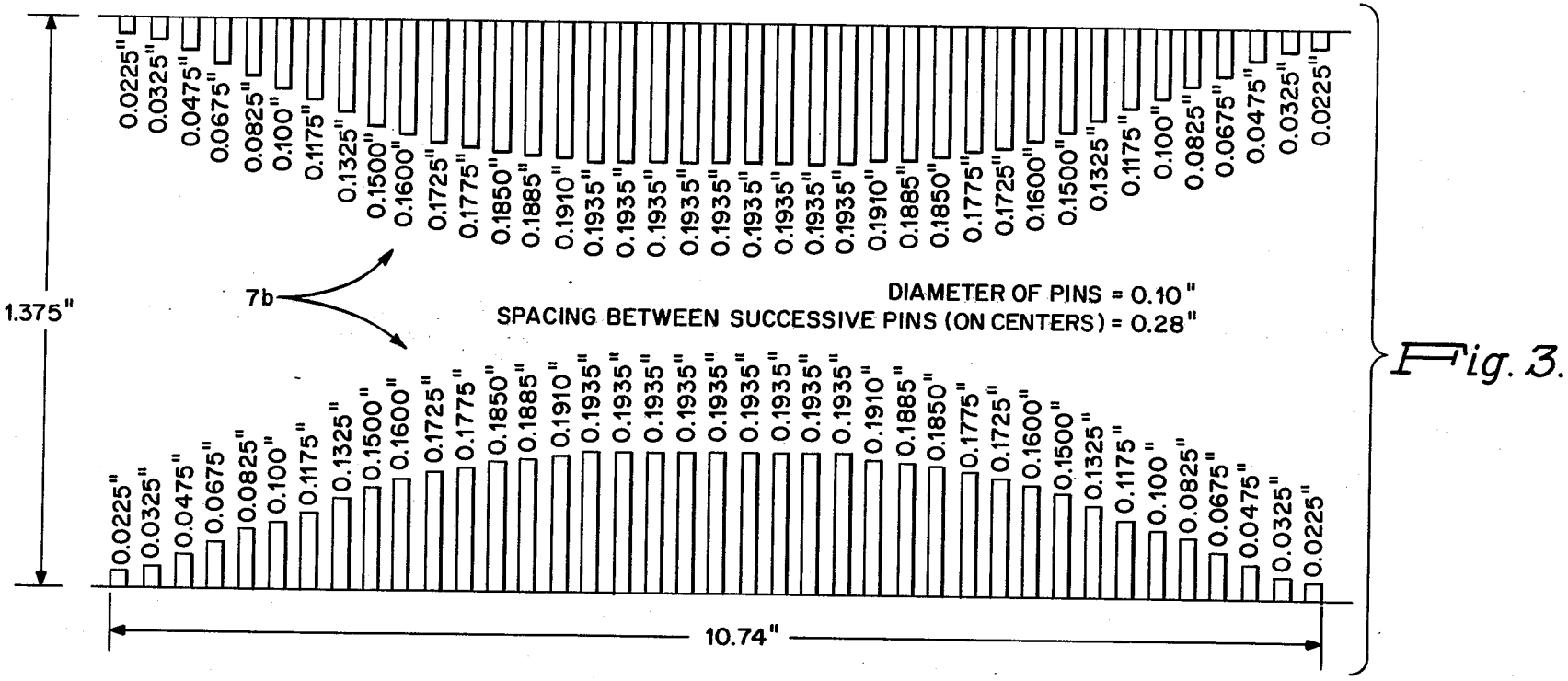
FIGS. 3 and 4 are enlarged cross-sectional views illustrating internal details of the polarizer device of FIG. 2.
Figure 4:
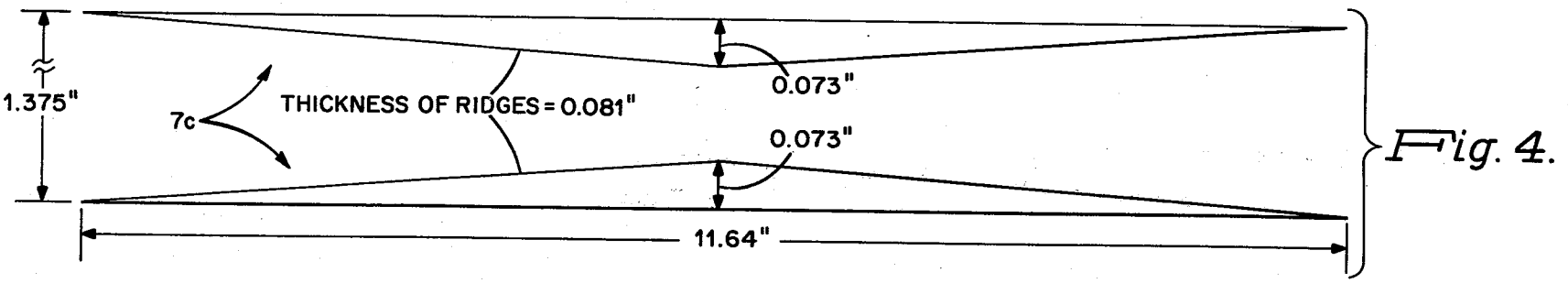

A particularly suitable implementation of the polarizer device 7 is shown in FIG. 2 and includes a circular section of waveguide *7a* having two opposing rows of spaced pins *7b* in a first common plane, and two opposing ridges *7c* in a second common plane transverse to the first plane. By appropriate design of the circular polarizer device 7, the rows of pins *7b* and the pair of ridges *7c* may be made to provide 120° and 30° phase shift contributions, respectively, with the resultant phase shift or differential being equal to 120° minus 30°, or 90°. The particular advantage of the above type of circular polarizer device 7 is that the resultant phase shift between the circularly-polarized signals is relatively constant over the entire frequency bandwidth of the transmitted signals (5.925 Ghz–6.425 Ghz), varying by only ±0.8° over the entire frequency bandwidth. Suitable dimensions for the pins and ridges by which this result can be achieved are set forth in FIGS. 3 and 4. For optimum operation of the diplexer apparatus 1, the polarizer device 7 is physically positioned with respect to the orthogonal mode transducer 5 to that the plane of either the rows of pins *7b* or the ridges *7c* of the polarizer device 7 is at an acute angle of 45° with respect to the plane of the broad wall of either of the rectangular waveguide sections of the orthogonal mode transducer 5. The circular polarizer device 7 as described hereinabove is also described and claimed in the aforementioned U.S. Pat. No. 4,100,514. For further details of the polarizer device 7, reference may be made to the aforementioned patent.

The circularly-polarized signals produced at the output of the circular polarizer device 7 as described above are coupled through the impedance-matching transformer device 9 to a first port at one end of the orthogonal mode transducer 12. The transformer device 9 serves, in known fashion, to match the impedance between the transducer 12 and the elements 5 and 7. The circularly-polarized signals coupled into the orthogonal mode transducer 12 are applied to a second, antenna port of the orthogonal mode transducer 12 and coupled via a suitable adapter (not shown) to the antenna for transmission to the desired target. It is further to be noted that while the orthogonal mode transducer 12 has other ports as indicated in FIG. 1, the transmitted circularly-polarized signals coupled to the antenna are prevented from being applied to and interfering with the receive portions of the diplexer apparatus 1 by means of a plurality of low-pass filters 16–19 coupled with these other ports. The low-pass filters 16–19, to be discussed more fully hereinafter, are constructed so as to act as short circuits to the frequency of the transmitted signals so that the signals do not pass into the receive portion of the diplexer apparatus 1. The filters 16–19 further act as matched impedances to signals of the second, lower frequency received from the antenna, as will also be discussed hereinafter. The diameter of the circular waveguide section of the orthogonal mode transducer 12 is such as to pass both the higher frequency transmitted signals and the lower frequency received signals. The smaller diameters of the circular polarizer device 7 and the circular waveguide section of the orthogonal mode transducer 5 are such as to pass only the higher frequency transmitted signals and cut off the lower frequency received signals.

Figure 5:
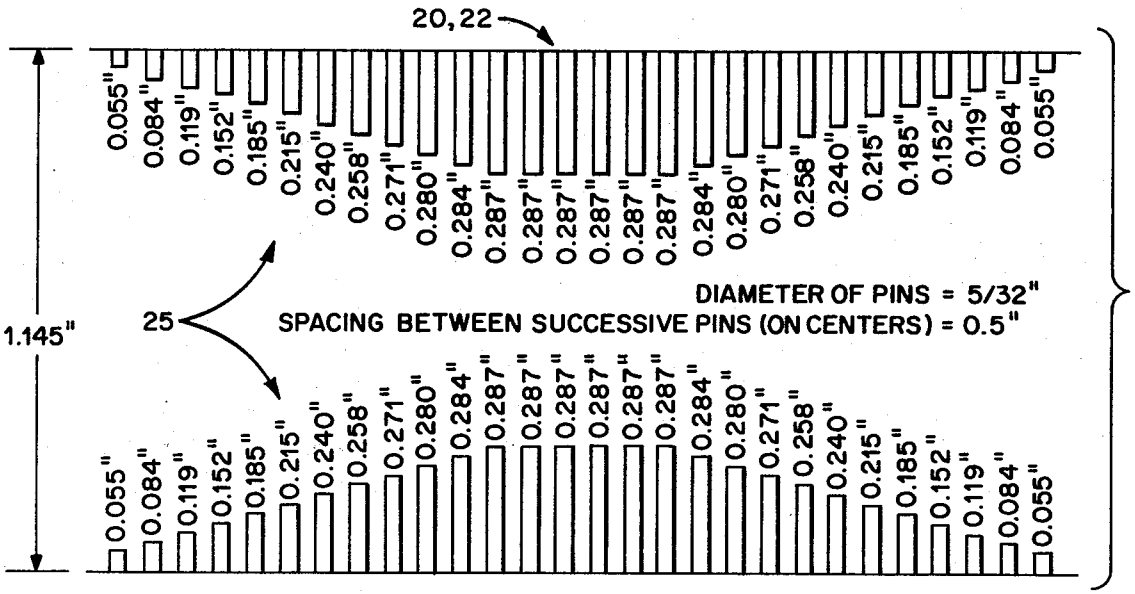
FIGS. 5 and 6 are enlarged cross-sectional views illustrating internal details of rectangular waveguide polarizer members employed in the diplexer apparatus of FIG. 1.
Figure 6:
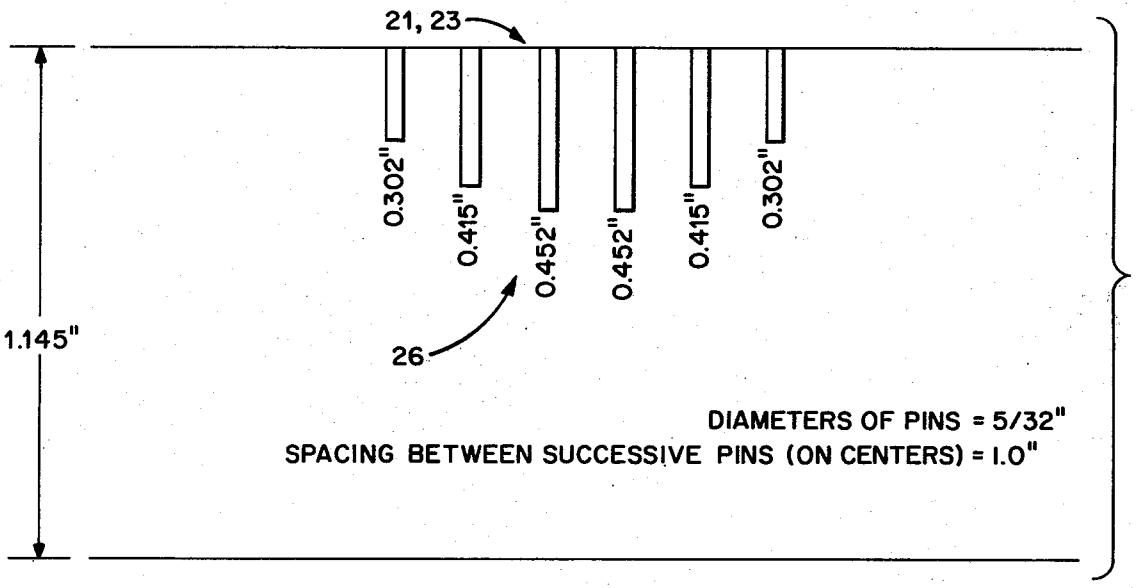

In the receive mode of operation of the diplexer apparatus 1, a pair of oppositely-rotating circularly-polarized signals of the lower frequency as received from the target and applied to the antenna are coupled into the antenna port of the orthogonal mode transducer 12. These signals, which may be designated as right-hand and left-hand circularly-polarized signals, are coupled from the orthogonal mode transducer 12 into four rectangular receive openings located at orthogonal positions in the circular waveguide section of the orthogonal mode transducer 12. Each opposed pair of openings may, for reasons of symmetry, be considered a separate port. The signals at the receive openings of the transducer 12 are coupled into the aforementioned low-pass filters 16–19 and four associated rectangular sections of waveguide 20–23 connected with the filters 16–19. One vectoral component of each of the circularly-polarized signals divides into two parts which are respectively coupled via the filters 16 and 18 into the sections of waveguide 20 and 22 and the other, orthogonal vectoral component of the signal similarly divides into two parts which are respectively coupled fia the filters 17 and 19 into the sections of waveguide 21 and 23. By way of specific example, the sections of waveguide 20 and 22 may conduct pairs of vertical vectoral components $\overrightarrow{LV1}$, $\overrightarrow{RV1}$ and $\overrightarrow{LV2}$, $\overrightarrow{RV2}$, respectively, derived from the left-hand and right-hand circularly-polarized signals and, similarly, the sections of waveguide 21 and 23 may conduct pairs of horizontal vectoral components $\overrightarrow{LH1}$, $\overrightarrow{RH1}$ and $\overrightarrow{LH2}$, $\overrightarrow{RH2}$, respectively, derived from the left-hand and right-hand circularly-polarized signals. Each of the diagonally-opposed sections of waveguide 20 and 22 is constructed in accordance with the present invention to have opposing rows of spaced pins 25 therein, as shown in FIG. 5, for introducing a phase shift contribution to the vectoral components applied to that section, and, similarly, each of the diagonally-opposed sections of waveguide 21 and 23 is constructed to have a single row of pins 26 therein, as shown in FIG. 6, for introducing a phase shift contribution to the vectoral components applied to that section. The rows of pins 25 and 26 are located centrally along the broad walls of the respective sections of waveguide 20–23 as indicated in FIG. 1 and may be variously located along the lengths of the sections of waveguide 20–23 so long as the rows of pins 25 in the sections 20 and 22 have the same relative locations and the rows of pins 26 in the sections 21 and 23 have the same relative locations. At the output ends of the sections of waveguide 20–23 which are connected to orthogonally-related ports of a third orthogonal mode transducer 28, the various vectoral components operated on by the pins within the sections of waveguide 20–23 combine in the circular waveguide section of the third orthogonal mode transducer 28 to provide pairs of vectoral components represented vectorally by $\overrightarrow{LV}=\overrightarrow{LV1}+\overrightarrow{LV2}$, $\overrightarrow{RV}=\overrightarrow{RV1}+\overrightarrow{RV2}$ and $\overrightarrow{LH}=\overrightarrow{LH1}+\overrightarrow{LH2}$, $\overrightarrow{RH}=\overrightarrow{RH1}+\overrightarrow{RH2}$. The pin-loaded sections of waveguide 20–23 accordingly act as polarizer devices, in the manner of the aforedescribed circular polarizer device 7, and convert or transform the circularly-polarized signals coupled into the second orthogonal mode transducer 12 into orthogonal linearly-polarized signals ($\overrightarrow{LV}$, $\overrightarrow{RV}$ and $\overrightarrow{LH}$, $\overrightarrow{RH}$) within the third orthogonal mode transducer 28. The linearly-polarized signals within the circular waveguide section of the orthogonal mode transducer 28 are coupled into one end of a fourth orthogonal mode transducer 30. The transducer 30 includes a pair of rectangular waveguide sections 32 and 34 at acute angles of 45° with respect to the sections of waveguide 20–23 and operates to derive from the orthogonal components in the transducer 28 a pair of orthogonal linearly-polarized resultant signals each corresponding to a different one of the circularly-polarized signals and represented vectorally by $\overrightarrow{L}=\overrightarrow{LV}+\overrightarrow{LH}$ and $\overrightarrow{R}=\overrightarrow{RV}+\overrightarrow{RH}$. The signals $\overrightarrow{L}$ and $\overrightarrow{R}$ are coupled to the waveguide sections 32 and 34 of the transducer 30 for use by respective receiver apparatus (not shown). It is to be noted that the provision of pins within the sections of waveguide 20–23 obviates the need for a circular polarizer device as shown at 7 between the two orthogonal mode transducers 28 and 30 with the result that the length of the diplexer apparatus 1 is substantially reduced, for example, by approximately two feet in a typical construction.

It is to be noted that as the abovedescribed receive operations take place, the circularly-polarized signals as received by the antenna are blocked from transmit portions 5, 7 and 9 of the diplexer apparatus 1. As previously discussed, this blocking is accomplished by the appropriate selection of diameters for these components which serve to cut off the lower frequency received signals while allowing the passage of higher frequency transmitted signals. Thus, the only possible path for the circularly-polarized received signals is into the rectangular waveguide sections 20–23 via the associated low-pass filters 16–19. As previously mentioned these filters act as matched impedances to the circularly-polarized received signals while acting as short circuits to transmitted signals. Details of the low-pass filters are described in the aforementioned U.S. Pat. No. 3,731,235 to DiTullio et al.

Thus, by the provision of pins within the rectangular waveguide sections 20–23 and by the use of the circular polarizer device 7, the diplexer apparatus 1 may be used for processing circularly-polarized signals while having a reduced overall length. As a result, losses in the diplexer apparatus 1 are reduced over prior art diplexer apparatus. The diplexer apparatus 1 may also be used in installations where space is at a premium, for example, in installations employing small antennas, e.g., 8–16 meter diameter antennas.

While there has been described what is considered to be the preferred embodiment of the invention, it will be obvious to those skilled in the art that various changes and modifications may be made therein without departing from the invention as called for in the appended claims.

What is claimed is:

1. Diplexer apparatus comprising:

first transducer means having first and second input ports and an output port, said first transducer means being operative to receive first and second signals within a first frequency bandwidth at the first and second input ports, respectively, and to establish said signals at the output port thereof to be orthogonal and linearly-polarized with respect to each other;

first polarizer means coupled to the first transducer means and operative to transform the orthogonal linearly-polarized signals at the output port of the first transducer means to orthogonal circularly-polarized signals;

electromagnetic wave conducting means having a first port coupled to the first polarizer means and a second port, said electromagnetic wave conducting means being operative to pass the circularly-polarized signals from the first polarizer means to the second port thereof, said electromagnetic wave conducting means further having a third port and a fourth port and being further operative to receive first and second circularly-polarized signals within a second frequency bandwidth at the second port and to couple orthogonal vectoral components of said circularly-polarized signals within the second frequency bandwidth to the third and fourth ports;

second polarizer means coupled to the third and fourth ports of the electromagnetic wave conducting means and operative to introduce a predetermined phase shift differential between the vectoral components of the circularly-polarized signals at the third and fourth ports, said phase shifted vectoral components being orthogonal and linearly-polarized with respect to each other; and output means coupled to the second polarizer means and having first and second output ports, said output means being operative to combine the vectoral components of the orthogonal linearly-polarized signals derived by the second polarizer means from the first and second circularly-polarized signals into first and second resultant orthogonal linearly-polarized signals each corresponding to a different one of the circularly-polarized signals and to present the first and second resultant linearly-polarized signals to separate ones of the first and second output ports.

2. Diplexer apparatus in accordance with claim 1 wherein the first transducer means includes:

a first orthogonal mode transducer having a circular section of waveguide and a pair of rectangular sections of waveguide coupled into the circular section of waveguide and having input openings corresponding to the first and second input ports, said input openings being orthogonally-related to each other.

3. Diplexer apparatus in accordance with claim 2 wherein:

the first polarizer means includes a section of waveguide coupled to the circular section of waveguide of the orthogonal mode transducer and having first and second rows of pins and a pair of ridges therein, the rows of pins lying within a first plane and the pair of ridges lying within a second plane orthogonal to the first plane.

4. Diplexer apparatus in accordance with claim 3 wherein:

the section of waveguide of the first polarizer means is a circular section of waveguide, said circular section of waveguide being physically positioned with respect to the orthogonal mode transducer of the first transducer means so that either one of the first and second planes is at an acute angle with respect to the plane of either one of the first and second rectangular sections of waveguide of the orthogonal mode transducer.

5. Diplexer apparatus in accordance with claim 4 wherein the electromagnetic wave conducting means comprises:

a second orthogonal mode transducer including a circular section of waveguide having an opening at one end thereof corresponding to the first port, an opening at the other end thereof corresponding to the second port, and first and second orthogonally-related rectangular openings in the wall thereof; and first and second filters coupled into the first and second orthogonally-related rectangular openings in the wall of the circular section of waveguide of the second orthogonal mode transducer, said filters being operative to block passage therethrough of vectoral components of signals within the first frequency bandwidth and to permit passage therethrough of vectoral components of signals within the second frequency bandwidth.

6. Diplexer apparatus in accordance with claim 5 wherein the output means comprises:

a third orthogonal mode transducer including a circular section of waveguide having first and second orthogonally-related rectangular openings in the wall thereof and an opening at one end thereof, the second polarizer means being coupled between the first and second filters of the electromagnetic wave conducting means and the first and second openings in the wall of the circular section of waveguide of the third orthogonal mode transducer, said third orthogonal mode transducer being operative to combine the vectoral components of the orthogonal linearly-polarized signals derived by the second polarizer means from the first and second circularly-polarized signals into corresponding pairs of vectoral components orthogonal and linearly-polarized with respect to each other; and a fourth orthogonal mode transducer including a circular section of waveguide coupled to the opening at the end of the circular section of waveguide of the third orthogonal mode transducer and first and second orthogonally-related rectangular sections of waveguide coupled into the circular section of waveguide and at acute angles to the first and second openings in the wall of the circular section of waveguide of the third orthogonal mode transducer, said fourth orthogonal mode transducer being operative to derive from the vectoral components from the third orthogonal mode transducer first and second orthogonal linearly-polarized resultant signals each corresponding to a different one of the circularly-polarized signals and to couple the resultant signals separately to the first and second rectangular sections of waveguide thereof.

7. Diplexer apparatus in accordance with claim 6 wherein the second polarizer means comprises:

first and second sections of rectangular waveguide coupled respectively between the first and second filters of the electromagnetic wave conducting means and the first and second orthogonally-related openings in the wall of the circular section of waveguide of the third transducer, said first section of rectangular waveguide having a pair of opposing rows of pins therein and said second section of rectangular waveguide having a single row of pins therein.

8. Diplexer apparatus in accordance with claim 7 wherein:

the pins of the opposing rows of pins in the first section of rectangular waveguide have heights varying along the lengths of the rows and the pins of the single row of pins in the second section of rectangular waveguide have heights varying along the length of the row.

9. Diplexer apparatus in accordance with claim 1 wherein:

the first polarizer means includes a section of waveguide coupled to the output port of the first transducer means and having first and second rows of pins and a pair of ridges therein, the rows of pins lying within a first plane and the pair of ridges lying within a second plane orthogonal to the first plane.

10. Diplexer apparatus in accordance with claim 1 wherein:

the second polarizer means includes first and second sections of rectangular waveguide coupled to the third and fourth ports of the electromagnetic wave conducting means, respectively, said first section of rectangular waveguide having a pair of opposing rows of pins therein and said second section of rectangular waveguide having a single row of pins therein.

11. Diplexer apparatus in accordance with claim 10 wherein:

the pins of the opposing rows of pins in the first section of rectangular waveguide have heights varying along the lengths of the rows and the pins of the single row of pins in the second section of rectangular waveguide have heights varying along the length of the row.

12. Diplexer apparatus comprising:

a first orthogonal mode transducer having first and second orthogonally-related input ports and an output port, said first transducer being operative to receive first and second signals within a first frequency bandwith at the first and second input ports, respectively, and to establish said signals at the output port thereof to be orthogonal and linearly-polarized with respect to each other;

a polarizer including a circular section of waveguide coupled to the output port of the first orthogonal mode transducer and having two opposing rows of pins therein, in a first common plane, and two opposing ridges therein, in a second common plane orthogonal to the first plane, said polarizer being positioned physically with respect to the first orthogonal mode transducer so that either the first plane or the second plane is at an acute angle with respect to either of the orthogonally-related input ports of the first orthogonal mode transducer, and said polarizer being operative to transform the orthogonal linearly-polarized signals at the output port of the first orthogonal mode transducer to circularly-polarized signals;

electromagnetic wave conducting means coupled to the polarizer and comprising a second orthogonal mode transducer including:

a section of circular waveguide having a first opening at one end thereof coupled to the circular section of waveguide of the polarizer, a second opening at the other end thereof adapted to receive first and second orthogonal circularly-polarized signals within a second frequency bandwidth, and third, fourth, fifth and sixth diametrically-opposed, orthogonally-related openings in the wall thereof, said circular section of waveguide being operative to pass orthogonal circularly-polarized signals from the first opening thereof to the second opening thereof and to pass orthogonal circularly-polarized signals from the second opening to the third, fourth, fifth and sixth openings; and first, second, third and fourth filters coupled, respectively to the third, fourth, fifth and sixth openings in the circular section of waveguide, respectively, of the second orthogonal mode transducer, said filters being operative to prevent passage therethrough of vectoral components of circularly-polarized signals within the first frequency bandwidth and to permit passage therethrough of orthogonal vectoral components of circularly-polarized signals within the second frequency bandwidth;

first, second, third and fourth sections of rectangular waveguide coupled to the first, second, third and fourth filters, respectively, the first and third sections of rectangular waveguide each having a pair of opposing rows of pins therein and the second and fourth sections of rectangular waveguide each having a single row of pins therein, said first, second, third and fourth sections of rectangular waveguide being operative to introduce phase shift differentials between the vectoral components of orthogonal circularly-polarized signals passing through the first, second, third and fourth filters, said phase shifted vectoral components being orthogonal and linearly-polarized;

a third orthogonal mode transducer including a circular section of waveguide having first, second, third and fourth diametrically-opposed, orthogonally-related openings in the wall thereof coupled to the first, second, third and fourth sections of rectangular waveguide, respectively, and having a opening at one end thereof, said third orthogonal mode transducer being operative to combine the vectoral components of the orthogonal linearly-polarized signals derived by the first, second, third and fourth sections of rectangular waveguide from the first and second circularly-polarized signals into first and second corresponding pairs of vectoral components orthogonal and linearly-polarized with respect to each other; and a fourth orthogonal mode transducer including a circular section of waveguide coupled to the opening at the end of the circular section of waveguide of the third orthogonal mode transducer and first and second orthogonally-related sections of waveguide coupled into the circular section of waveguide and at acute angles to the openings in the wall of the circular section of the third orthogonal mode transducer, said fourth orthogonal mode transducer being operative to derive from the pairs of vectoral components from the third transducer means first and second orthogonal linearly-polarized resultant signals each corresponding to a different one of the circularly-polarized signal and to couple the resultant signals separately to the first and second rectangular sections of waveguide thereof.

13. Diplexer apparatus in accordance with claim 12 wherein:

the pins of the pair of opposing rows of pins in the first and third sections of rectangular waveguide have heights varying along the lengths of the rows.

14. Diplexer apparatus in accordance with claim 13 wherein:

the pins of the single rows of pins in the second and third sections of rectangular waveguide have heights varying along the lengths of the rows.

* * * * *